United States Patent [19]

Burgess et al.

[11] Patent Number: 4,605,494

[45] Date of Patent: Aug. 12, 1986

[54] MULTISTREAM, MULTIPRODUCT, PRESSURE MANIPULATION BENEFICIATION ARRANGEMENT

[75] Inventors: Lester E. Burgess, Media; Phillip E. McGarry, Palmerton; David E. Herman, Jim Thorpe, all of Pa.

[73] Assignee: Sohio Alternate Energy Development Co., Cleveland, Ohio

[21] Appl. No.: 650,961

[22] Filed: Sep. 14, 1984

[51] Int. Cl.[4] ..... B03D 1/02

[52] U.S. Cl. ..... 209/166; 209/170

[58] Field of Search ..... 209/166–170

[56] References Cited

U.S. PATENT DOCUMENTS

| | | | |
|---|---|---|---|
| 2,184,115 | 12/1939 | Coke | 209/168 |
| 2,249,570 | 7/1941 | Lane et al. | 209/166 |
| 2,310,240 | 2/1943 | Keck | 209/166 |
| 2,804,341 | 8/1957 | Bete | 239/601 |
| 4,347,126 | 8/1982 | McGarry et al. | 209/168 |
| 4,347,127 | 8/1982 | Duttera et al. | 209/168 |
| 4,436,617 | 3/1984 | Moore et al. | 209/170 |
| 4,477,338 | 10/1984 | Hellman | 209/171 |
| 4,514,291 | 4/1985 | McGarry et al. | 209/166 |

FOREIGN PATENT DOCUMENTS

| | | | |
|---|---|---|---|
| 3108727 | 9/1982 | Fed. Rep. of Germany | 209/166 |
| 3223170 | 12/1983 | Fed. Rep. of Germany | 209/170 |
| 174380 | 1/1983 | United Kingdom | 209/170 |

*Primary Examiner*—Bernard Nozick

*Attorney, Agent, or Firm*—Bruce E. Harang; David J. Untener; Larry W. Evans

[57] ABSTRACT

An improved method and apparatus for froth flotation separation of the components of a slurry, having particular utility for the beneficiation of coal by the flotation separation of coal particles from impurities associated therewith, such as ash and sulfur. In this arrangement, a forward product stream is formed in which a mixture of the particulate matter slurry and the chemical reagents is sprayed through a nozzle at a first relatively low pressure onto the surface of water in a forward stream flotation tank to create a floating froth phase containing therein a first quantity of the particulate matter. The remainder of the particulate matter slurry separates from the froth phase by sinking in the water, and the froth phase is separated as a first product. The remainder of the particulate matter slurry is then directed to a scavenger product stream in which the separated slurry is sprayed through a second nozzle at a second higher pressure onto the surface of water in a second scavenger stream flotation tank to create a floating froth phase containing therein a second quantity of the particulate matter. The second froth phase is then separated as a second product. The amounts of the products recovered in the first and second product streams are substantially independently adjustable by controlling the first and second spraying pressures.

4 Claims, 5 Drawing Figures

MULTISTREAM, MULTIPRODUCT, PRESSURE MANIPULATION BENEFICIATION ARRANGEMENT

BACKGROUND OF THE INVENTION

1. Field of the Invention

The present invention relates generally to a multistream, multiproduct method and apparatus for flotation separation of coal particles and similar materials, and more particularly pertains to an improved multistream, multiproduct method and apparatus for beneficiation of coal by flotation separation of a froth generated by a spray nozzle such that ground coal particles may be separated from impurities associated therewith such as ash and sulfur.

Coal is an extremely valuable natural resource in the United States because of its relatively abundant supplies. It has been estimated that the United States has more energy available in the form of coal than in the combined natural resources of petroleum, natural gas, oil shale, and tar sands. Recent energy shortages, together with the availability of abundant coal reserves and the continuing uncertainties regarding the availability of crude oil, have made it imperative that improved methods be developed for converting coal into a more useful energy source.

2. Discussion of the Prior Art

Many known prior art processes for froth flotation separation of a slurry of particulate matter are based on constructions wherein air is introduced into the liquid slurry of particulate matter, as through a porous cell bottom or a hollow impeller shaft, thereby producing a surface froth. These prior art methods are relatively inefficient approaches, especially when large amounts of particulate matter are being processed . Generally, these techniques are inefficient in providing sufficient contact area between the particulate matter and the frothing air. As a result, large amounts of energy were required to be expended to generate the froth. In addition, froth flotation techniques which permit bubbles to rise in the slurry can tend to trap and carry impurities such as ash in the froth slurry, and accordingly the resultant beneficiated particulate product frequently has more impurities therein than necessary.

Methods have been suggested and are being explored in the beneficiation of coal, i.e., the cleaning of coal of impurities such as ash and sulfur, either prior to burning the coal or after its combustion. In one recently developed technique for beneficiation, termed herein chemical surface treating, raw coal is pulverized to a fine mesh size and is then chemically treated. According to this technique, the treated coal is then separated from ash and sulfur, and a beneficiated or cleaned coal product is recovered therefrom. In further detail, in the heretofore mentioned chemical surface treating process, coal is first cleaned of rock and the like, and is then pulverized to a fine size of about 48 to 300 mesh. The extended surfaces of the ground coal particles are then rendered hydrophobic and oleophilic by a polymerization reaction. The sulfur and mineral ash impurities present in the coal remain hydrophilic and are separated from the treated coal product in a water washing step. This step utilizes oil and water separation techniques, and the coal particles made hydrophilic can float in recovery on a water phase which contains hydrophilic impurities.

In greater detail, McGarry et al., U.S. Pat. Nos. 4,347,126 and Duttera et al., 4,347,127, both of which are commonly assigned herewith, disclose similar arrangements for the beneficiation of coal by the flotation separation of coal particles from impurities associated therewith such as ash and sulfur. In these arrangements, a primary spray hollow jet nozzle is positioned above a flotation tank having a water bath therein, and sprays an input slurry through an aeration zone into the surface of the water. The spraying operation creates a froth on the water surface in which a substantial quantity of particulate matter floats, while other components of the slurry sink into the water bath. A skimming arrangement skims the froth from the water surface as a cleaned or beneficiated product. A recycling operation is also provided wherein particulate materials which do not float after being sprayed through the primary spray nozzle are recycled to a further recycle, hollow jet spray nozzle to provide a second opportunity for recovery of the recycled particles.

One type of spray nozzle currently being used in a coal beneficiation process of the type described in these patents is a full jet nozzle, as is available commercially from Spraying Systems, Co., Wheaton, Ill., and this type of nozzle can be utilized in association with the present invention. However, a spiral, open flow type of nozzle is preferably contemplated for use in preferred embodiments of the present invention, as disclosed in U.S. Pat. Application Ser. No. 495,626, filed May 18, 1983 now U.S. Pat. No. 4,514,291 , and is available commercially from several different manufacturers in many different types of materials including polypropylene and tungsten carbides.

These previous beneficiation arrangements generally contemplate an output of a single product stream, although the slurry being treated therein can be processed through several different stages, such as several serially arranged froth cells or tanks. The production of a single product output stream has implicit therein the inherent limitation that operation of the system will result in a given percentage recovery at a related percentage of mineral impurities such as ash and sulfur. Generally, a higher percentage recovery of product also results in a higher percentage of impurities therein, and vice versa. Accordingly, these previous beneficiation arrangements do not offer a great deal of flexibility in terms of recovery of several different product grades with different impurity levels therein.

SUMMARY OF THE INVENTION

Accordingly, it is a primary object of the present invention to provide an improved multiple stream, multiple product method and apparatus for froth flotation separation of a slurry of particulate matter to produce more than one product stream. In greater particularity, it is a more detailed object of the present invention to provide an improved multiple stream, multiple product method and apparatus for beneficiating coal by a froth flotation separation of ground coal particles from impurities associated therewith by utilizing more than one product recovery stream, which allows a great deal of versatility and flexibility in selecting both the percentage of recovery and the percentage of impurities in each individual product recovery stream. A multiple stream, multiple product approach allows the recovery of a cleaner, premium product from the first product stream, while still allowing the remainder of the product to be recovered at a lower ash content than the original feed.

A further object of the subject invention is the provision of an improved multiple stream, multiple product method and apparatus for treating particulate material such as carbonaceous particles, non-carbonaceous particles, or mixtures of both, coal particles, mine tailings, oil shale, residuals, waste particulates, mineral dressings, graphite, mineral ores, fines, etc.

Another object of the present invention is to provide a method and apparatus for froth flotation separation which is more efficient and can result in a cleaner product and in more efficient production than prior art operations. The subject invention is extremely versatile as the treatment in each individual product stream can be separately controlled to control both the percentage of product recovery and the percentage of impurities in the product produced by that stream. For instance, a first product stream can be controlled to yield a very clean first stream product having a very low percentage of impurities therein, while a second product stream can be controlled to recover a large percentage of the remaining product at a percentage of impurities which is still below that of the initial feed. Moreover, additional product streams can also be added to yield additional desired products.

In accordance with the teachings herein, the present invention provides an improved multistream and multiproduct arrangement, including both a method and apparatus, for froth flotation separation of the components of a slurry having particulate matter therein. In these arrangements, chemical reagents are first mixed with the input slurry to condition the surfaces of the particulate matter. The chemically conditioned slurry is then directed to a forward product stream in which a first applied pressure forces the slurry spray from a nozzle onto the surface of water in a forward stream flotation tank to create a floating froth phase thereon. The froth phase includes a first quantity of the particulate matter therein, and the remainder of the slurry separates from the froth phase by sinking to the bottom of the flotation tank. The froth phase is then separated as a first product.

The remainder of the slurry from the bottom of the tank is directed to a second scavenger product stream in which a second and higher pressure forces the slurry to spray from a second nozzle onto the surface of water in a scavenger stream flotation tank. The spraying operation creates a second floating froth phase which includes a second quantity of the particulate matter therein. The remainder of the particulate matter slurry again separates from the froth phase by sinking in the scavenger stream flotation tank. The second froth phase is then separated as a second product, such that first and second separate product streams are separated from the input slurry.

The present invention has particular utility in the beneficiation of coal wherein the input slurry comprises a slurry of coal particles and associated impurities such as ash, and the chemical reagents comprise surface treating chemicals for the coal particles.

In a preferred embodiment, the scavenger stream includes a series of froth flotation tanks and associated spray nozzles for sequential cleaning of the slurry, and a spiral, open flow type of spray nozzle has proven to be particularly effective. Moreover, in one particularly advantageous mode of operation, the first pressure is sufficiently low and the second pressure sufficiently high, that recovery in the scavenger stream is greater than the recovery in the forward stream, which results in a relatively clean first product stream.

The present invention involves a process in which the slurry is sprayed through an aeration zone such that substantial quantities of air are sorbed by the sprayed droplets of the slurry. Accordingly, large quantities of air are introduced into the froth in a manner which is quite different and advantageous relative to many prior art approaches. The advantages of this manner of froth generation make the teachings herein particularly applicable to froth flotation separation of slurries which have a substantial proportion of particulate matter.

BRIEF DESCRIPTION OF THE DRAWINGS AND TABLES

The foregoing objects and advantages of the present invention for a multistream, multiproduct beneficiation system may be more readily understood by one skilled in the art, with reference being had to the following detailed description of a preferred embodiment thereof, taken in conjunction with the accompanying drawings wherein like elements are designated by identical reference numerals through the several drawings, and in which.

Figure 4:
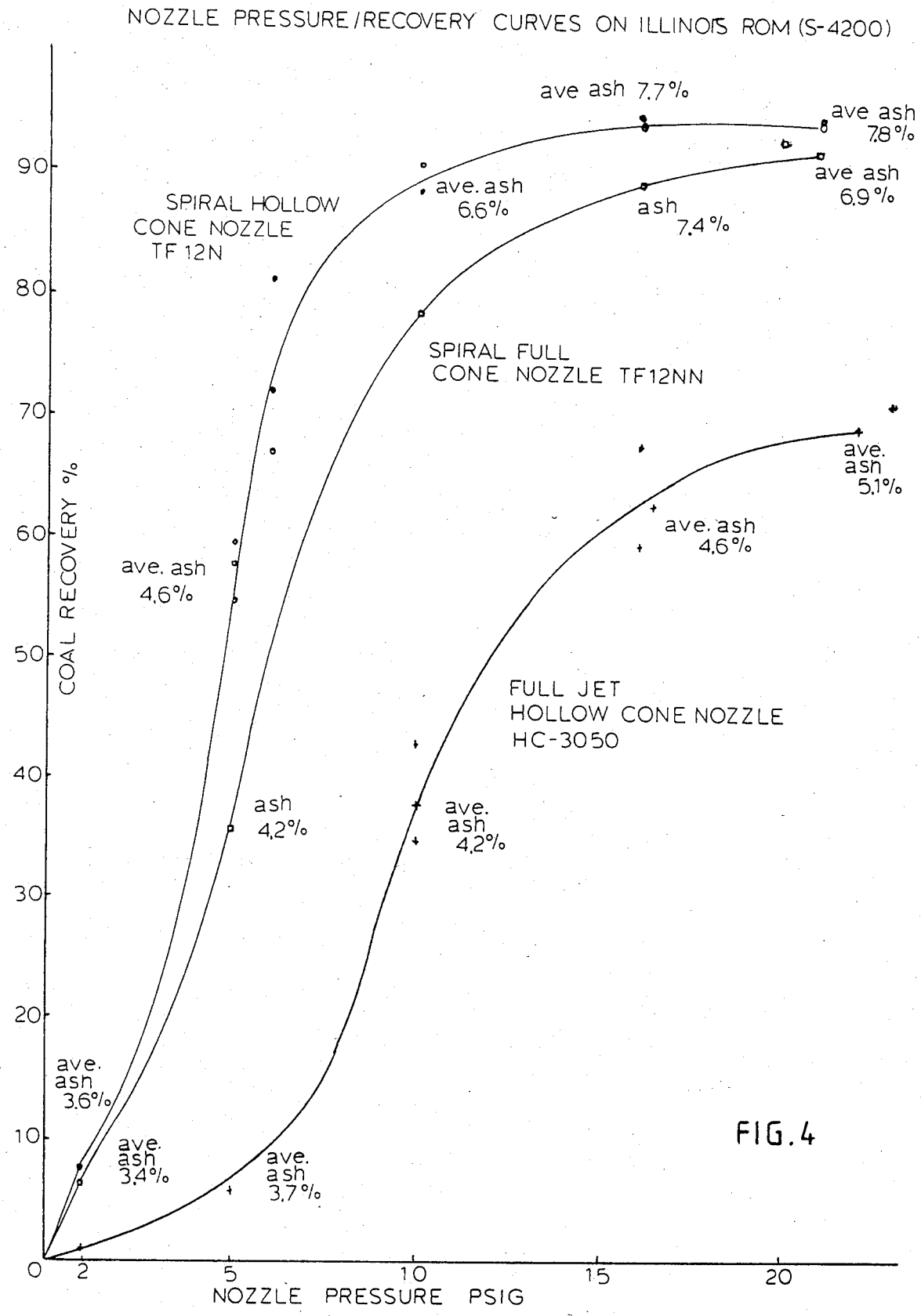
FIG. 4 illustrates several graphs of coal recovery of Illinois ROM coal, plotted as a function of nozzle pressure, and demonstrates the significantly improved results obtained pursuant to the present invention.

Tables 1 through 4 are data tables on Illinois ROM coal, including screen analysis and different nozzle tests at different nozzle pressures indicating both the percent coal recovery and the percent of the various constituents of both the feed and the product, supporting the graphs of FIG. 4; and Table 5 is a data table for tests run on Sohio Kitt coal at different nozzle pressures, and indicates both the percent coal recovery and the percent of the various constituents of both the feed and the product.

DETAILED DESCRIPTION OF THE PRESENT INVENTION

Figure 1:
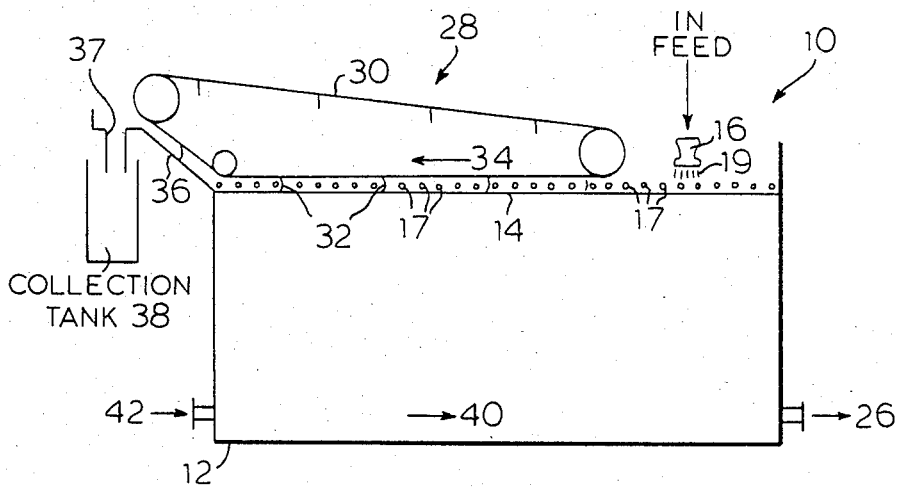
FIG. 1 is an elevational view of a schematic exemplary embodiment of a flotation arrangement constructed pursuant to the teachings of the present invention.

The apparatus and method of the present invention are adapted to the separation of a wide variety of solid-fluid streams by the creation of a solids containing froth phase, and are suitable for the separation of many types of particulate matter. However, the present invention is described herein in the context of a coal beneficiating operation. Thus, referring to the drawings in greater detail, FIG. 1 illustrates a first embodiment 10 having a flotation tank 12 filled with water to level 14. In operation a slurry of finely ground coal particles, associated impurities, and if desired additional additives such as monomeric chemical initiators, chemical catalysts and fluid hydrocarbons is sprayed through at least one nozzle 16 positioned at a spaced distance above the water level in tank 12. In alternative embodiments, two or more nozzles can be used to spray the slurry and/or any other desired ingredients into the tank.

The stream of treated coal is pumped under pressure through a manifold to the spray nozzle 16 wherein the resultant shearing forces spray the coal flocculent slurry as fine droplets such that they are forcefully jetted into the mass of a continuous water bath in tank 12 to form a froth 17. High shearing forces are created in nozzle 16, and the dispersed particles forcefully enter the surface of the water and break up the coal-oil-water flocs, thereby water-wetting and releasing ash from the interstices between the coal flocs and breaking up the coal flocs so that exposed ash surfaces introduced into the water are separated from the floating coal particles and sink into the water bath. The surfaces of the finely divided coal particles now contain air sorbed to the atomized particles, much of which is entrapped by spraying the slurry through an aeration zone 19 such that air is sorbed in the sprayed slurry. The combined effects on the treated coal cause the flocculated coal to decrease in apparent density and to float as a froth 17 on the surface of the water bath. The hydrophilic ash remains in the bulk water phase, and tends to settle downwardly in tank 12 under the influence of gravity. Tank 12 in FIG. 1 may be a conventional froth flotation tank commercially available from KOM-LINE-Sanderson Engineering Co., Peapack, N.Y., modified as set forth below. The flotation tank can also include somewhat standard equipment which is not illustrated in the drawings, such as a liquid level sensor and control system, and a temperature sensing and control system.

The present invention operates on a froth generation principle in which the slurry is sprayed through an aeration zone such that substantially greater quantities of air are sorbed by the sprayed finer droplets of the slurry. Accordingly, air is introduced into the slurry in a unique manner to generate the resultant froth. The advantages of this manner of froth generation make the teachings herein particularly applicable to froth flotation separation of slurries which have a substantial proportion of particulate matter therein.

The particles in the flotating froth created by nozzle 16 can be removed from the water surface, by e.g., a skimming arrangement 28 in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward a surface 36, preferably upwardly inclined, extending from the water surface to a collection tank 38 arranged at one side of the flotation tank, such that the skimmer plates 32 skim the froth from the water surface up the surface 36 and into the collection tank 38.

In the arrangement of the disclosed embodiment, the waste disposal at the bottom of the tank operates in a direction 40 flowing from an influent stream 42 to the effluent stream 26, while the skimmer arrangement at the top of the tank operates in direction 34 counter to that of the waste disposal arrangement. Although the illustrated embodiment shows a counter flow arrangement, alternative embodiments are contemplated within the scope of the present invention having, e.g., cross and concurrent flows therein.

As described in greater detail hereinbelow, a recycling arrangement similar to those described in U.S. Pat. Nos. 4,347,126 and 4,347,217 could also be utilized in association with the present invention, wherein a recycling technique is employed to further improve the efficiency relative to prior art arrangements. In the recycling technique, coal particles which do not float after being sprayed through the nozzle 16, designated a primary spray nozzle in context with this embodiment, are recycled to a further recycle spray nozzle to provide the coal particles a second cycle for recovery.

Figure 2:
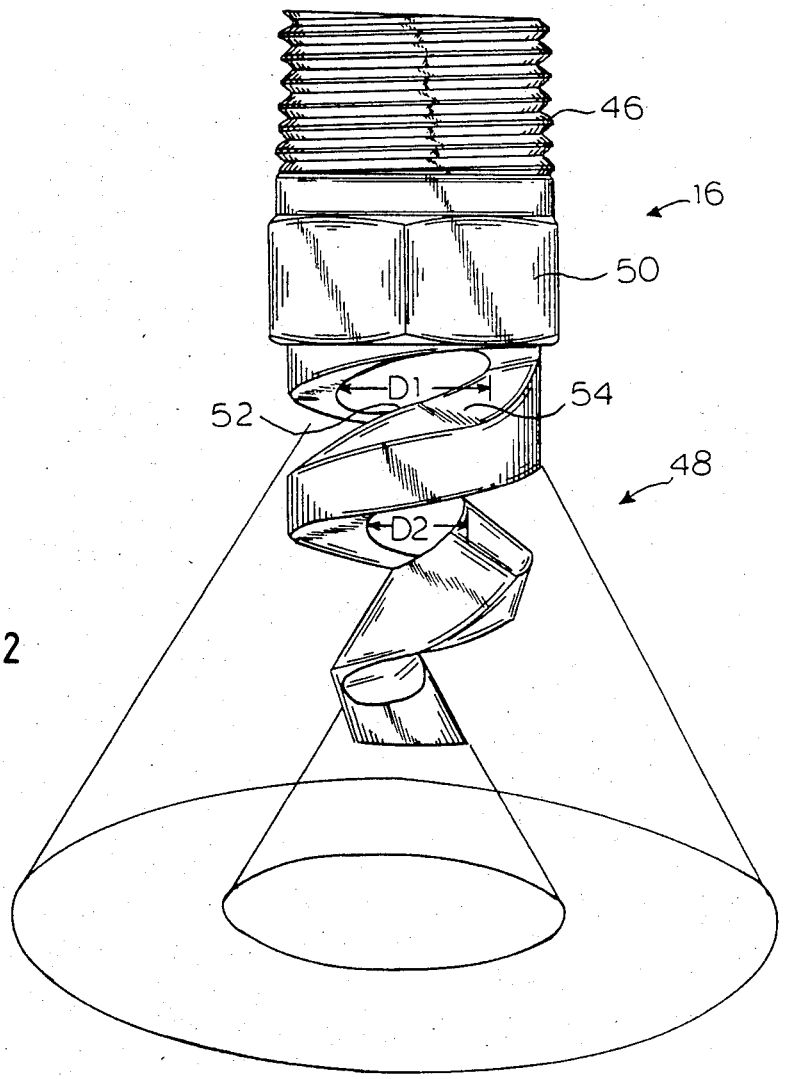
FIG. 2 is an elevational view of one embodiment of a spiral type of spray nozzle which can be utilized in accordance with the teachings of the present invention.

FIG. 2 is an elevational view of one embodiment of a spiral type of open flow spray nozzle 16 which is preferably utilized in association with the present invention. The spiral nozzle includes an upper threaded section 46 and a lower spiral, convoluted section 48. The upper section is threadedly coupled to an appropriate infeed conduit, from which the particulate matter slurry is pumped through an upper cylindrical bore 50 to the convoluted lower spiral section 48, in which the diameter of the spiral turns decreases progressively towards the bottom thereof. This is illustrated by the larger upper diameter D1 in the upper portion thereof and the reduced diameter D2 in the lower portion thereof.

During operation of the spiral spray nozzle, the particulate matter slurry is pumped through the upper cylindrical bore 50 into the convoluted lower spiral section 48 in which, as the internal diameter D decreases, the sharp inner and upper edge 52 of the convolute shears the outer diameter portion of the cylindrical slurry stream and directs it along the upper convolute surface 54 radially outwardly and downwardly. This shearing of the central slurry stream is performed progressively through the nozzle as the inner diameter D decreases progressively towards the bottom thereof.

Each nozzle may be tilted at an angle with respect to a vertical (i.e., the position of the nozzle relative to the liquid surface level), such that it functions to direct the flow of froth in a direction towards the skimmer arrangement 28. However, the angle of incidence does not appear to be critical, and the vertical positioning shown in FIG. 1 may be preferred to create a condition most conducive to agitation and froth generation at the water surface. It appears to be significant that the agitation created by the nozzle sprays define a zone of turbulence extending a limited distance beneath the water surface level. Among other means, the depth of the turbulence zone may be adjusted by varying the supply pressure of the slurry in the supply manifolds and also the distance of the nozzles above the water surface. In one operative embodiment, a zone of turbulence extending one to two inches beneath the water surface produced very good agitation and froth generation, although the distance is dependent on may variables such as the tank size, the medium in the tank, etc., and accordingly may vary considerably in other embodiments.

The test results plotted in FIG. 4, which are supported by the data in the following Tables 1 through 4, compare beneficiation achieved with a full jet nozzle as disclosed in McGarry, et al. U.S. Pat. No. 4,347,126, available from Spraying Systems Co., Wheaton, Ill., model SS 3050HC, with two types of spiral nozzles, available from Bete Fog Nozzle, Inc., Greenfield Mass. Two types of spiral nozzle design, a 60° full cone spiral, model TF-12NN, and a 50° hollow cone spiral, model TF-12N, and a full jet hollow cone nozzle model SS 3050HC, were tested and evaluated for coal recovery performance over wide ranges of nozzle pressures.

The beneficiation process of the tests described herein followed the general teachings and disclosure of Burgess et al. U.S. Pat. No. 4,304,573, which is expressly incorporated by reference herein. The tests were run as identically close to each other as possible using the same beneficiation procedure on the same equipment with a Ramoy pump and ball valves, with the exception of the nozzles, with the same type of coal and reagents, such as tall oil, 75% #6 fuel oil/ 25% #2 fuel oil, copper nictrate sol, $H_2O_2$, and 2-ethylhexanol (frothing agent). In alternative beneficiation processes, other chemical reagents could be utilized, for instance by the use of butoxyethoxypropanol (BEP) or methylisobutylcarbinol (MTBC) as the frothing agent.

The coal used in the tests of Tables 1 through 4 and FIG. 4 was a run-of-mine (ROM) Illinois #6 seam coal. Table I presents a screen analysis of the ground feed, and indicates the amount (percentage) of material remaining above a screen with the indicated mesh size, while the last negative (−) entry indicates the material passed through the 325 mesh screen. In Tables 2, 3, 4, and 5, the #/T Oil Level columns refer to pounds/ton of a mixture of 75% #6 fuel oil and 25% #2 fuel oil, and the constituents are given of both the feed and the product at the various test pressures. The full jet nozzle (HC-3050) and the hollow cone spiral nozzle (TF-12N) were tested first at pressures of 2, 5, 10, 16 and 22 psig. All other variable were held constant. Three tests were conducted with each nozzle at each pressure. The order in which the tests were run was randomized. Single tests were then run with the full cone spiral nozzle (TF-12NN) on the Illinois coal at the various stated pressure levels.

Figure 5:
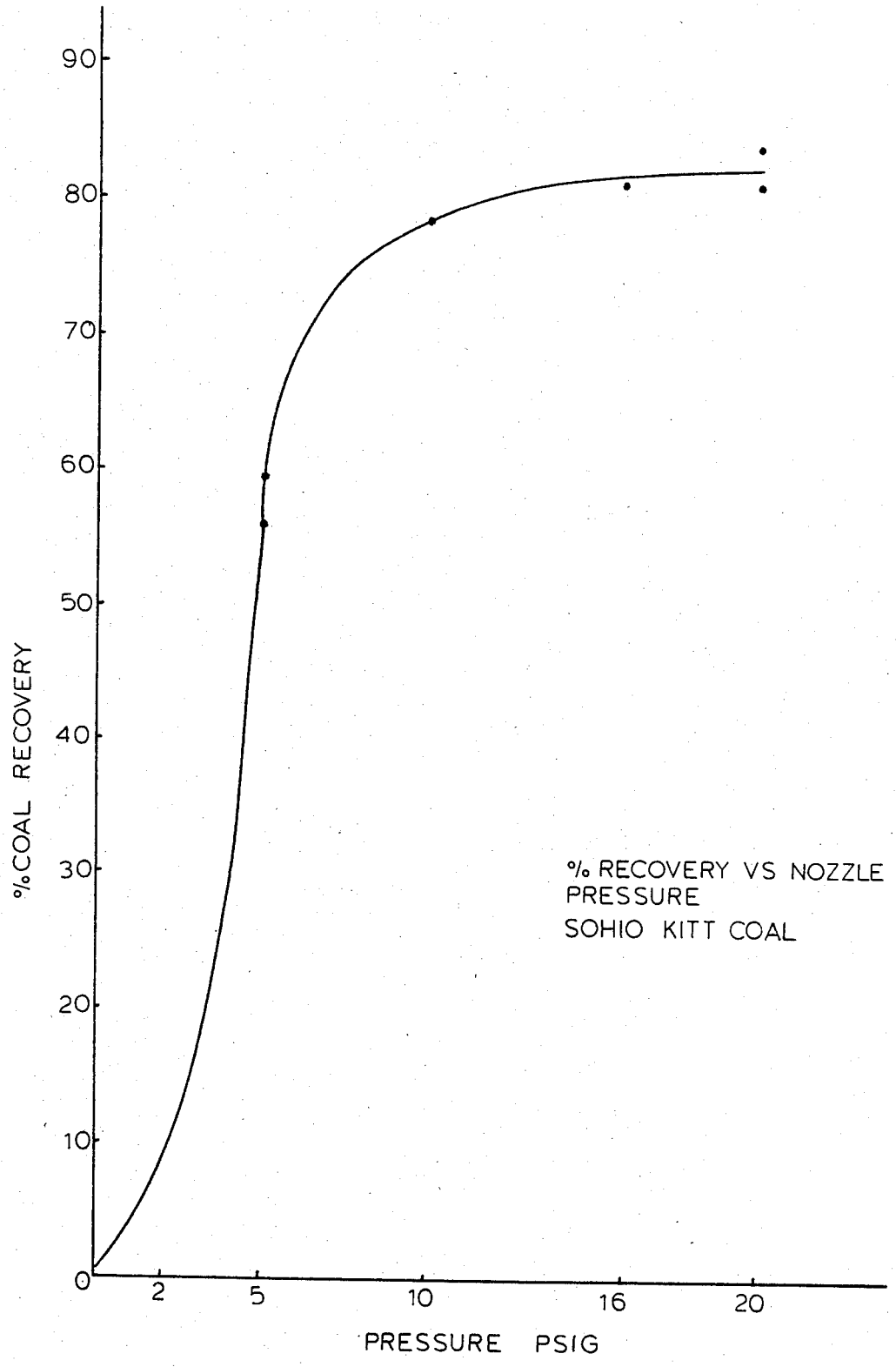
FIG. 5 is a graph of recovery of Sohio Kitt coal plotted as a function of different nozzle pressures.

The coal used in the tests of Table 5 and FIG. 5 was a Sohio Kitt coal which was tested at different nozzle pressures. Table 5 gives the percent coal recovery at the different nozzle pressures and the percent of the various constituents of both the feed and the product.

FIGS. 4 and 5 illustrate a significant feature relied upon by the present invention, which is that there is a correlation between nozzle pressure and both percent coal recovery and percent ash impurities. With all of the nozzles tested, a lower nozzle pressure resulted in both a lower percent coal recovery and lower percent ash impurities. Accordingly, these relationships are relied upon in the present invention to develop a multistream, multiproduct beneficiation arrangement.

Figure 3:
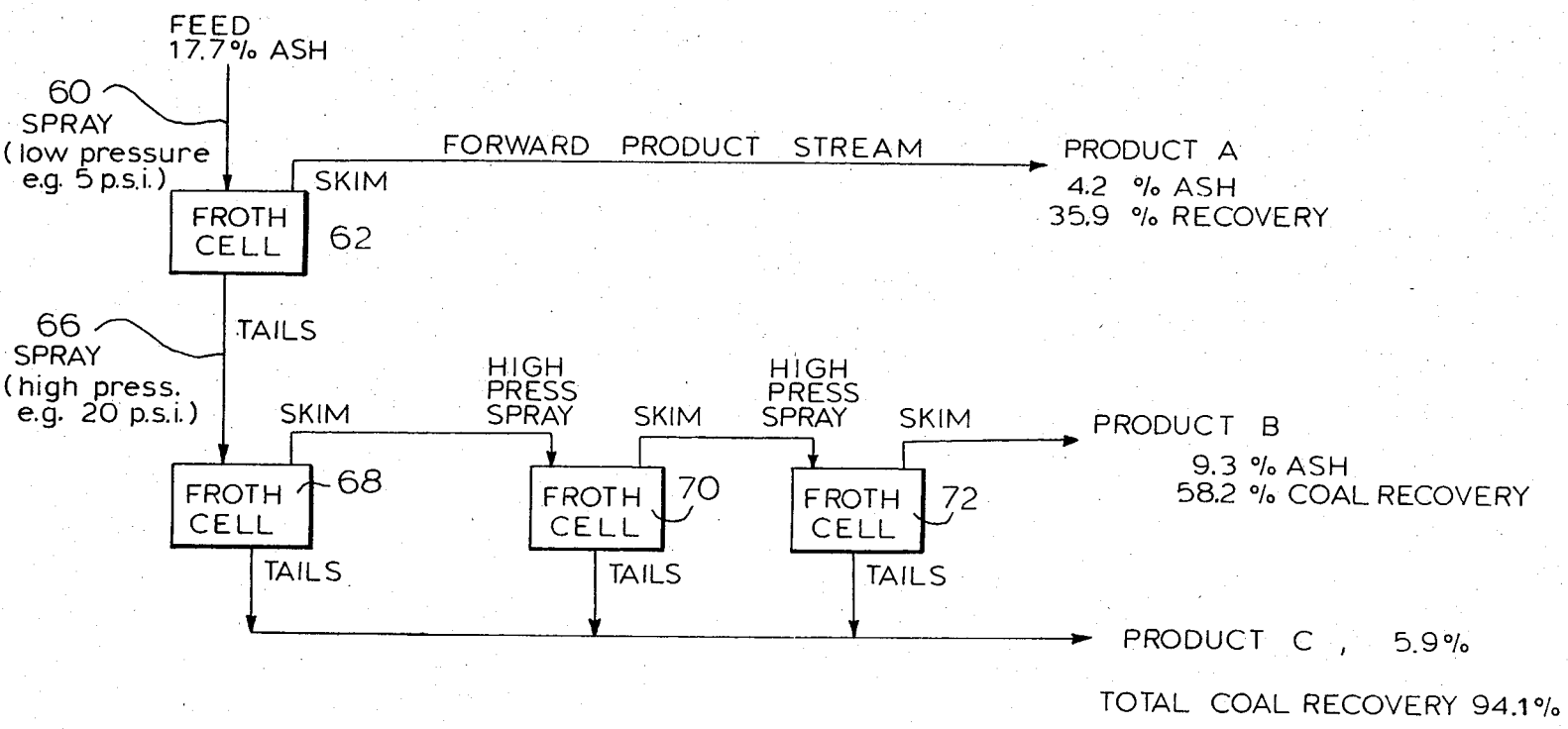
FIG. 3 illustrates one preferred embodiment and mode of operation of a multiple stream, multiple product coal beneficiation system.

FIG. 3 illustrates one embodiment of the present invention for a multiple stream, multiple product froth flotation separation system. In operation, a slurry of finely ground coal particles, associated impurities, and chemical reagents is beneficiated in a forward product stream in which a first applied pressure forces the slurry to spray at 60 from a nozzle onto the surface of water in a forward stream flotation tank 62 to create a floating froth phase thereon. The froth phase includes first quantity of the particulate matter therein, and the remainder of the slurry separates from the froth phase by sinking to the bottom of the flotation tank 62. The froth phase is then removed, as by a skimming operation at 64, to form the forward product stream.

The tails, containing the remaining particulate matter which separates from the froth phase by sinking in the forward stream flotation tank or tanks, are then directed to a scavenger stream operation. In the scavenger product stream, the slurry is sprayed through a nozzle at 66 at a second and higher pressure onto the surface of water in a scavenger stream flotation tank 68. The spraying operation creates a second floating froth phase which includes a second quantity of the particulate matter therein. The remainder of the particulate matter slurry again separates from the froth phase by sinking in the scavenger stream flotation tank 68. In a preferred embodiment, the slurry in the scavenger product stream is directed through a series of beneficiation froth tanks or cells 68, 70 and 72. The repeated spraying operations at the second and higher pressure in each of the tanks breaks the flocculates apart to a greater degree than an operation in only a single tank, thereby separating more of the ash impurities.

The present invention operates on the principle that the reduced spraying pressure in the forward stream results in recovery therein of only the particulate matter having the greatest percentage of coal (least percentage of ash impurities). The higher spraying pressure in the scavenger stream results in the recovery therein of a less clean product. The tails separated from the scavenger stream can be disposed of as refuse, or in alternative embodiments can be directed to additional scavenger streams for additional recovery.

FIG. 3 illustrates operation of one exemplary embodiment in which an input slurry feed having an ash impurity content of 17.7% was sprayed into the forward stream froth tank at a relatively low pressure of 5 psi. This resulted in a forward stream product A recovery of 35.9% with a relatively low ash impurity content of 4.2%, which represents a relatively clean product, considering the ash content of the feed. The remainder of the slurry recovered as tails from the forward stream was sprayed into the scavenger stream recovery tanks 68, 70 and 72 at a relatively high pressure of 20 psi, which resulted in a scavenger stream recovery of 58.2% with an ash impurity of 9.3% ash. The sum of the recoveries of both streams is thus 94.1 percent. The tails from the scavenger stream is labelled as product C, and can be disposed of as refuse, or directed to additional recovery operations.

Depending upon the selected parameters, the sum of the recoveries of the forward and scavenger streams can be selected to be equal to or better than recovery in a normal single product stream approach, which is limited to recovery along a single recovery curve. One very valuable advantage of the present invention is that the operations in the forward and subsequent streams can be selected to be along different desired recovery curves to yield products which are very clean, or less clean, or clean to whatever percentage ash is desired. Consequently, the subject invention is extremely versatile as the treatment in each individual product stream can be separately controlled to control both the percentage of product recovery and the percentage of impurities in the product produced by that stream. For instance, the first product stream can be controlled to yield a very clean first stream product having a very low percentage of impurities therein and also a low percentage of recovery, while a second product stream can be controlled to recover a large percentage of the remaining product at a percentage of impurities which is still below that of the initial feed.

It is advantageous in the serially connected froth tanks in the scavenger product stream to arrange the water flow from tank to tank to be counter or opposite to the serial flow of the coal particulate matter from tank to tank. Accordingly, as the coal particulate matter moves forward through the tanks for additional cleaning operations, the water moves in the opposite direction. In the first cleaning operation, the least clean water is used, and in the last cleaning operation, the cleanest water is used. Relatively deep tanks permit a counterflow operation with minimal loss of coal in counterflowing water or contamination of clean coal with mineral matter. Moreover, the counterflow operation keeps makeup water requirements low, and minimizes the discharge of water. This last aspect is becoming increasingly important in areas having a water shortage or where water is relatively costly. Counterflow cleaning has another advantage in that some coals or fractions of coals naturally contain very little finely-divided, or inherent, mineral matter. This coal can be effectively isolated from the coal that has more mineral matter by the controlled coal recovery.

TABLE 1

SCREEN ANALYSIS OF ILLINOIS ROM (S-4200)

| U.S. Mesh | Aperture (Microns) | Weight % | Cumulative % Finer | Cumulative % Coarser |
|---|---|---|---|---|
| 100 | 149 | 0.7 | 99.3 | 0.7 |
| 140 | 105 | 5.4 | 93.9 | 6.1 |
| 200 | 74 | 14.7 | 79.2 | 20.8 |
| 270 | 53 | 16.3 | 62.9 | 37.1 |
| 325 | 44 | 3.9 | 59.0 | 41.0 |
| −325 | −44 | 59.0 | | |
| | | 100.0 | | |

TABLE 2

HOLLOW CONE FULL JET NOZZLE TESTS ON ILLINOIS ROM COAL (S-4200)

| Nozzle Pressure PSIG | #/T Oil Level | % Ash Feed | % Ash Prod. | % Volatiles Feed | % Volatiles Prod. | % Fixed Carbon Feed | % Fixed Carbon Prod. | % Coal Recovery |
|---|---|---|---|---|---|---|---|---|
| 2 | 10 | 17.55 | 4.09 | 34.11 | 39.41 | 48.35 | 56.51 | 1.72 |
| | | 16.95 | 3.63 | 29.72 | 39.79 | 48.75 | 56.58 | 1.23 |
| | | 17.17 | 3.17 | 34.81 | 39.23 | 49.15 | 57.60 | 1.84 |
| 5 | 10 | 17.03 | 4.01 | 34.17 | 39.72 | 48.80 | 56.27 | 6.43 |
| | | 17.71 | 3.72 | 33.80 | 38.99 | 48.49 | 57.29 | 6.46 |
| | | 17.53 | 3.33 | 34.09 | 39.72 | 48.38 | 56.95 | 8.09 |
| 10 | 10 | 17.14 | 3.99 | 33.54 | 38.18 | 49.32 | 57.83 | 43.56 |
| | | 17.43 | 4.11 | 33.31 | 38.40 | 49.26 | 57.49 | 35.40 |
| | | 17.00 | 4.38 | 33.73 | 38.28 | 49.27 | 57.34 | 36.86 |
| 16 | 10 | 17.39 | 4.34 | 35.09 | 39.58 | 47.52 | 56.08 | 60.30 |
| | | 17.32 | 4.57 | 33.64 | 38.00 | 49.04 | 57.43 | 68.95 |
| | | 16.84 | 4.81 | 34.39 | 38.66 | 48.78 | 56.53 | 65.12 |
| 22 | 10 | 17.27 | 5.88 | 34.30 | 38.00 | 48.43 | 56.12 | 88.71 |
| | | 17.34 | 4.73 | 34.20 | 38.16 | 48.47 | 57.11 | 62.25 |
| | | 17.28 | 4.55 | 34.41 | 38.86 | 48.31 | 56.59 | 62.33 |

TABLE 3

HOLLOW CONE SPIRAL NOZZLE TESTS ON ILLINOIS ROM COAL (S-4200)

| Nozzle Pressure PSIG | #/T Oil Level | % Ash Feed | % Ash Prod. | % Volatiles Feed | % Volatiles Prod. | % Fixed Carbon Feed | % Fixed Carbon Prod. | % Coal Recovery |
|---|---|---|---|---|---|---|---|---|
| 2 | 10 | 17.52 | 3.68 | 35.42 | 39.85 | 47.97 | 56.48 | 7.71 |
| | | 17.44 | 3.79 | 34.32 | 38.94 | 48.34 | 57.27 | 6.90 |
| | | 17.77 | 3.44 | 33.06 | 39.11 | 49.17 | 57.54 | 10.96 |
| 5 | 10 | 16.61 | 4.59 | 34.12 | 38.29 | 49.27 | 57.12 | 59.64 |
| | | 17.12 | 4.60 | 34.44 | 39.00 | 48.44 | 56.40 | 57.87 |
| | | 17.06 | 4.63 | 34.10 | 38.59 | 48.83 | 56.78 | 55.08 |
| 10 | 10 | 17.60 | 6.42 | 33.25 | 36.81 | 49.15 | 56.77 | 88.96 |
| | | 17.73 | 6.48 | 34.09 | 37.75 | 48.18 | 55.77 | 91.15 |
| | | 18.25 | 6.82 | 34.12 | 37.58 | 47.63 | 55.60 | 89.68 |
| 16 | 10 | 17.05 | 7.36 | 34.71 | 37.73 | 48.24 | 54.91 | 95.24 |
| | | 17.53 | 8.00 | 34.87 | 37.82 | 47.56 | 54.18 | 95.83 |
| | | 17.68 | 7.81 | 34.22 | 37.21 | 48.10 | 54.98 | 95.59 |
| 21 | 10 | 17.99 | 7.85 | 35.71 | 39.01 | 46.31 | 53.15 | 93.38 |
| | | 17.10 | 7.33 | 34.97 | 37.85 | 47.93 | 54.82 | 95.85 |
| | | 17.30 | 8.31 | 34.47 | 37.20 | 48.23 | 54.49 | 96.09 |

TABLE 4

FULL CONE SPIRAL NOZZLE TESTS ON ILLINOIS ROM COAL (S-4200)

| Nozzle Pressure (psig) | #/T Oil Level | % Ash Feed | % Ash Prod. | % Volatiles Feed | % Volatiles Prod. | % Fixed Carbon Feed | % Fixed Carbon Prod. | % Coal Recovery |
|---|---|---|---|---|---|---|---|---|
| 2 | 10 | 17.74 | 3.45 | 34.37 | 40.34 | 47.90 | 56.21 | 7.17 |
| 5 | 10 | 17.05 | 4.20 | 34.93 | 40.34 | 48.02 | 55.46 | 35.88 |
| 10 | 10 | 16.96 | 4.75 | 34.20 | 38.41 | 48.80 | 56.79 | 78.95 |
| 16 | 10 | 19.79 | 7.55 | 34.10 | 37.90 | 46.11 | 54.55 | 93.55 |
| 16 | 10 | 17.91 | 7.22 | 35.05 | 38.59 | 47.04 | 54.19 | 90.23 |
| 20 | 10 | 14.92 | 6.48 | 34.91 | 37.69 | 50.17 | 55.83 | 92.48 |
| 20 | 10 | 17.73 | 7.33 | 35.11 | 38.51 | 47.16 | 54.17 | 94.11 |

TABLE 5

SOHIO KITT COAL - PRESSURE/RECOVERY

| Nozzle Pressure PSIG. | % Ash Feed | % Ash Prod. | % Sulfur Feed | % Sulfur Prod. | % Volatiles Feed | % Volatiles Prod. | % Fixed Carbon Feed | % Fixed Carbon Prod. | % Coal Recovery |
|---|---|---|---|---|---|---|---|---|---|
| 2 | 21.44 | 4.03 | 2.70 | 0.94 | 26.38 | 31.13 | 52.19 | 64.84 | 30.96 |
| 5 | 21.84 | 4.89 | 2.75 | 0.97 | 27.32 | 31.65 | 50.84 | 63.46 | 53.17 |
| 5 | 21.46 | 4.55 | 2.61 | 0.98 | 27.15 | 31.57 | 51.39 | 63.88 | 56.00 |
| 10 | 21.77 | 5.97 | 2.58 | 1.04 | 26.93 | 30.81 | 51.31 | 63.23 | 78.86 |
| 16 | 21.97 | 6.15 | 2.58 | 1.03 | 27.16 | 30.94 | 50.87 | 62.91 | 81.91 |
| 20 | 21.58 | 5.55 | 2.61 | 1.07 | 27.34 | 31.26 | 51.09 | 63.19 | 81.73 |
| 20 | 21.73 | 5.72 | 2.56 | 1.07 | 27.69 | 31.59 | 50.59 | 62.69 | 89.63 |

| REAGENT - ALL TESTS | #/T |
|---|---|
| FUEL OIL | 2.5 |
| TALL OIL | 0.5 |
| COPPER NITRATE | 1.0 |
| HYDROGEN PEROXIDE | 1.0 |
| 2-ETHYLHEXANOL | 0.49 |

While a preferred embodiment and several variations of the present invention for a flotation separation arrangement are described in detail herein, it should be apparent that the disclosure and teachings of the present invention will suggest many alternative designs to those skilled in the art.

What is claimed is:

1. A multiple stream, multiple product method for froth flotation separation of the components of an input slurry having particulate coal therein, comprising:

(a) mixing chemical reagents with the input slurry to condition the surfaces of the particulate coal in the slurry, said chemical reagents comprising a monomer, a catalyst and a fluid hydrocarbon;

(b) in a forward product stream, applying a first pressure to the particulate coal slurry mixture to force it through and cause it to spray from at least one nozzle onto the surface of a liquid to create a floating froth phase on the liquid surface having a first quantity of the particulate coal therein, and allowing the remainder of the particulate coal slurry mixture to separate from the froth phase by sinking in the liquid, and separating the froth phase as a first product; and (c) in a second scavenger product stream, applying a second pressure, greater than said first pressure, to the remainder of the separated particulate coal slurry mixture to force it through and cause it to spray from at least one nozzle onto the surface of a liuqid to create a second floating froth phase on the liquid surface having a second quantity of the particulate coal therein, and allowing the remainder of the particulate coal slurry to separate from the froth phase by sinking in the liquid, and separating the second froth phase as a second product, whereby first and second separate product streams are separated from the input slurry.

2. A multiple stage, multiple product froth flotation separation method as claimed in claim 1, including conducting a series of spraying and separating steps in each of said forward and said scavenger stream.

3. A multiple stage, multiple product froth flotation separation method as claimed in claim 2, each spraying step utilizing a spiral, open flow spray nozzle.

4. A multiple stage, multiple product froth flotation separation method as claimed in claim 1, each spraying step utilizing a spiral, open flow spray nozzle.

* * * * *

UNITED STATES PATENT AND TRADEMARK OFFICE

CERTIFICATE OF CORRECTION

PATENT NO. : 4,605,494

DATED : August 12, 1986

INVENTOR(S) : Burgess et al

It is certified that error appears in the above-identified patent and that said Letters Patent is hereby corrected as shown below:

Column 7, line 14, "(MTBC)" should read -- (MIBC) --.

Signed and Sealed this

Twenty-eighth Day of October, 1986

[SEAL]

*Attest:*

DONALD J. QUIGG

*Attesting Officer* *Commissioner of Patents and Trademarks*